US005505326A

United States Patent [19]

Junko

[11] Patent Number: 5,505,326

[45] Date of Patent: Apr. 9, 1996

[54] CLOSURE DEVICE FOR MEMBRANE-SEALED CONTAINER

[76] Inventor: Theodore P. Junko, 5097 Duguid Rd., Manlius, N.Y. 13104

[21] Appl. No.: 250,541

[22] Filed: May 27, 1994

[51] Int. Cl.[6] ..... B65D 17/44

[52] U.S. Cl. ..... 220/278; 206/222; 215/228; 220/212; 220/277; 220/281; 222/80; 222/81; 222/83; 222/85

[58] Field of Search ..... 220/212, 277, 220/278, 281, 89.3; 215/228, 257; 206/222; 222/80, 81, 85, 83.5, 83

[56] References Cited

U.S. PATENT DOCUMENTS

| | | | |
|---|---|---|---|
| 3,156,369 | 11/1964 | Bowes et al. | 206/222 |
| 3,865,267 | 2/1975 | Morris | 215/224 X |
| 4,211,334 | 8/1980 | Witten et al. | 220/89.3 |
| 4,340,147 | 7/1982 | McIntosh . | |
| 4,634,013 | 1/1987 | Bar-Kokhba . | |
| 4,709,822 | 12/1987 | Vataru . | |
| 4,770,305 | 9/1988 | Su | 220/278 X |
| 5,090,582 | 2/1992 | Art et al. . | |

*Primary Examiner*—Allan N. Shoap
*Assistant Examiner*—Robin A. Hylton
*Attorney, Agent, or Firm*—Nixon, Hargrave, Devans & Doyle

[57] ABSTRACT

A closure device for a container having an opening sealed with a membrane comprises: a cap adapted to engage the opening of the container for closing same and comprising a first cylindrical wall connected to one side of a circular base; and a membrane-penetrating element comprising a second cylindrical wall connected to the reverse side of the circular base and, within the second cylindrical wall, means for penetrating a membrane when the element is pressed into contact with the opening of a container sealed with the membrane, the means comprising a plurality of arciform cutters that are connected to the base and are coaxial with and in close proximity to the inner surface of the second cylindrical wall, the plurality of arciform cutters together comprising a total of at least 300 degrees.

17 Claims, 5 Drawing Sheets

CLOSURE DEVICE FOR MEMBRANE-SEALED CONTAINER

FIELD OF THE INVENTION

This invention relates to a closure device for a membrane-sealed container and, more particularly, to such a device that includes means for penetrating the membrane.

BACKGROUND OF THE INVENTION

Containers sealed by membranes find wide-commercial use. The enclosed contents, which include such varied materials as medicine, foodstuffs, cleaning products, or other household or automotive, may be liquids or solids. The latter may be in the form of powders, granules, or tablets. Depending on the application, the containers may vary widely in size and shape, from narrow-necked bottles to wide-mouthed jars, and may be formed from various materials such as plastic or glass.

A simple and convenient way of removing the membrane seal from a container to gain access to its contents is very desirable. It may also be important to prevent the cut membrane from falling into the container. Several approaches to opening a membrane-sealed container are described in the prior art.

U.S. Pat. No. 4,340,147 discloses a dual function cap for a necked container sealed with a membrane in which the piercing element is centered in a cup-like cap with tapered sidewalls.

U.S. Pat. No. 4,634,013 discloses a device for closing and opening a membrane-sealed bottle provided with means for cutting the membrane without pushing the membrane downward while cutting and means for allowing rotation of the cap less than 360 degrees so that the cut membrane is not completely detached from the bottle.

U.S. Pat. No. 4,709,822 discloses a child resistant upright bottle neck and cap combination that includes a cutter in a compartment on top of the cap. The compartment containing the cutter is placed over the neck containing a seal, which is cut by rotating the inverted cap.

U.S. Pat. No. 5,090,582 discloses a threaded bottle cap that includes a seal puncturing means which produces a C-shaped opening in the seal when the cap is rotated.

A cap used to enclose membrane-sealed containers may vary widely in its structure and mode of function. Typically molded from plastic, it may include a thread for securing it to a container with a threaded opening. Alternatively, the cap may be of a press-on design, whereby the container is closed by application of pressure on the cap against the opening and conversely is opened by lifting the cap away from the opening. The cap may also incorporate lock lugs for securing it to the container, opening being accomplished by aligning the lugs with channels in the neck of the container prior to separating it from the cap.

The membranes used to seal the contents of the container may serve purposes of safety and security, i.e., prevent contamination or tampering, or it may serve to insure freshness of contents such as foodstuffs. These membranes, which may be formed from a variety of materials such as plastic films, metal foils, paper, or composites of the same, exhibit differences in properties such as flexibility and toughness. The closure device of the present invention provides for the easy, convenient penetration of such membranes, even those of large cross-section on wide-mouthed containers, simply by pressing the cutters of the device against them.

BRIEF SUMMARY OF THE INVENTION

A closure device for a container having an opening sealed with a membrane comprises: a cap adapted to engage the opening of the container for closing same and comprising a first cylindrical wall connected to one side of a circular base; and a membrane-penetrating element comprising a second cylindrical wall connected to the reverse side of the circular base and, within the second cylindrical wall, means for penetrating a membrane when the element is pressed into contact with the opening of a container sealed with the membrane, the means comprising a plurality of arciform cutters that are connected to the base and are coaxial with and in close proximity to the inner surface of the second cylindrical wall, the plurality of arciform cutters together comprising a total of at least 300 degrees.

In a further embodiment, the closure device comprises: a cap adapted to engage the opening of the container for closing same and comprising a cylindrical wall connected to a circular base; a cylindrical collar that is detachably connected to the top of the cylindrical wall; and within the cylindrical wall and connected to the base, means for penetrating a membrane when the means is pressed into contact with the opening of a container sealed with the membrane following detachment of the collar from the wall, the means comprising a plurality of arciform cutters that are connected to the base and are coaxial with and in close proximity to the inner surface of the wall, the plurality of arciform cutters together comprising a total of at least 300 degrees.

Because the closure device of the invention provides complete or substantially complete separation of the membrane from the container opening simply by pressing the membrane-penetrating element into contact with the sealed opening, no rotation of the device being required, it can be advantageously employed with containers whose openings have non-circular perimeters. Thus, in another embodiment the closure device comprises: a cap adapted to engage the opening of the container for closing same and comprising a first continuous wall connected to one side of a base along the perimeter of the base; and a membrane-penetrating element comprising a second continuous wall connected to the reverse side of the base along the perimeter of the base and, within the second continuous wall, means for penetrating a membrane when the element is pressed into contact with the opening of a container sealed with a membrane, the means comprising a plurality of elongate cutters that are connected to the base and are each situated in close proximity to the inner surface of the second continuous wall and in a parallel relationship to that portion of the inner surface closest to each cutter, whereby the membrane is separated completely or substantially completely from the opening when the element is pressed into contact with the opening.

The perimeter of the base of the closure device, which corresponds in shape to the container opening, may be of various non-circular forms, for example, an oval or a rectangle. Pressing the membrane-penetrating element into contact with the membrane sealing the opening of a container may result in complete separation of the membrane from the opening. Alternatively, if it is desired to prevent the cut membrane from falling into the container, the device can provide for substantially complete separation of the membrane from the opening, with a small portion of the membrane remaining uncut and attached to the opening. Completion of the separation of the membrane from the opening can be subsequently accomplished manually.

Detailed Description

Figure 1:
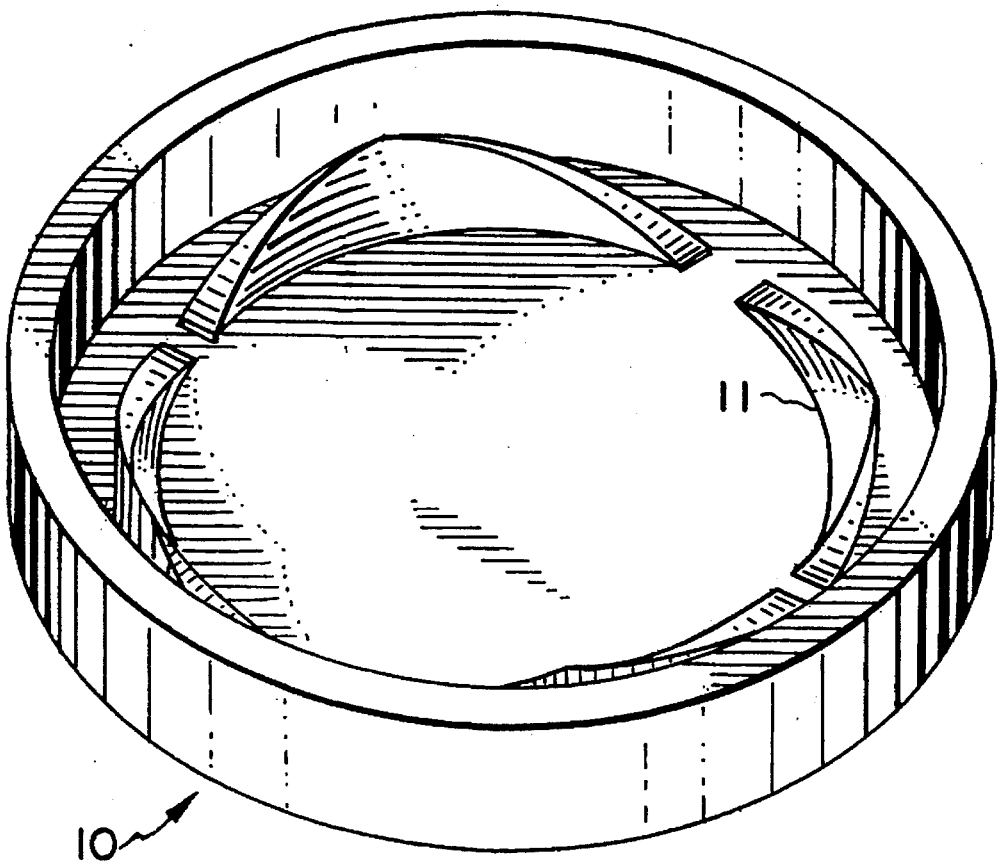
FIG. 1 is a perspective top view of the closure device of the invention.

FIG. 1 is a perspective view of a closure device 10 of the invention, showing the plurality of arciform, i.e., formed like an arc of a circle, cutters 11 of the membrane-penetrating element.

Figure 2:
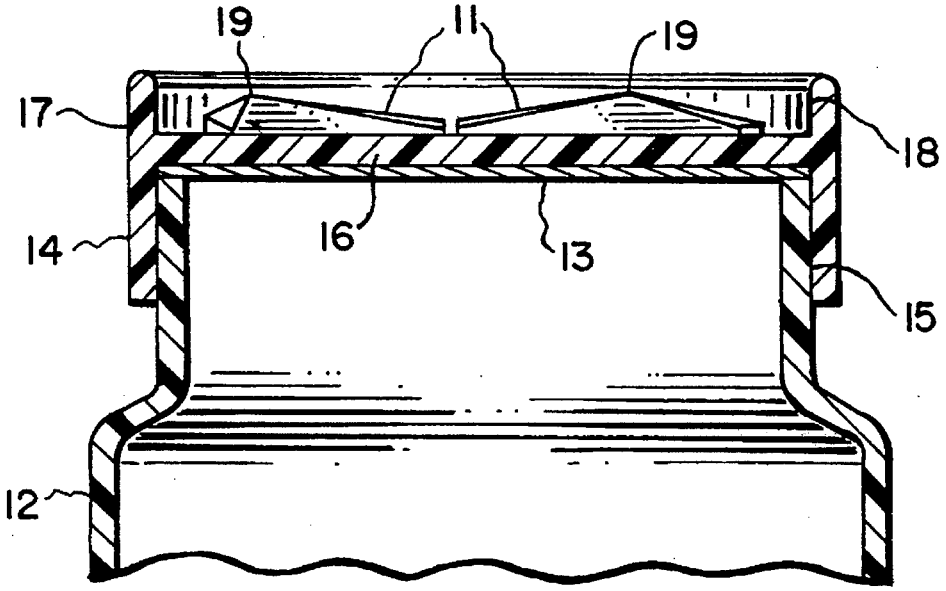
FIG. 2 is a partial sectional side view of the closure device engaged with the opening of a membrane-sealed container.

FIG. 2 depicts a preferred embodiment of the closure device on a container 12 sealed with a membrane 13. The cap 14, which engages the opening of the container, comprises a first cylindrical wall 15 connected to one side of a circular base 16. The membrane-penetrating element 17 comprises a second cylindrical wall 18 connected to the base 16 on its reverse side and, located within the second cylindrical wall, a plurality of arciform cutters 11, each having an apex 19.

Figure 3:
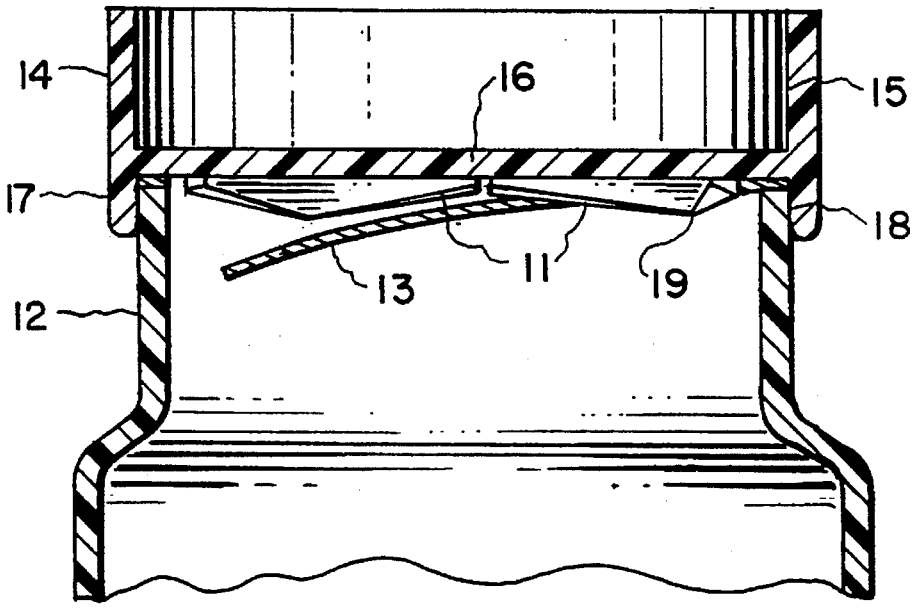
FIG. 3 is a partial sectional side view of the closure device inverted on the container opening to penetrate the membrane.

FIG. 3 depicts the closure device of FIG. 2 inverted on the opening of the container 12 so that, when the membrane-penetrating element 17 is pressed down on the opening, the plurality of cutters 11 penetrate the membrane 13. This causes the membrane to be cut almost completely from the opening of the container, giving access to its contents. Unlike the devices of the previously described U.S. Pat. Nos. 4,634,013, 4,709,822, and 5,090,582, the closure device of the present invention requires no rotating motion to cut the membrane. The simple application of downward pressure results in almost complete separation of the membrane from the container opening; only a small portion of the membrane remains uncut and attached to the opening, which prevents the membrane from falling into the container. The membrane can then be completely removed from the container manually. If desired, however, the membrane may be completely cut by rotating the membrane-penetrating element on the container opening.

Figure 4:
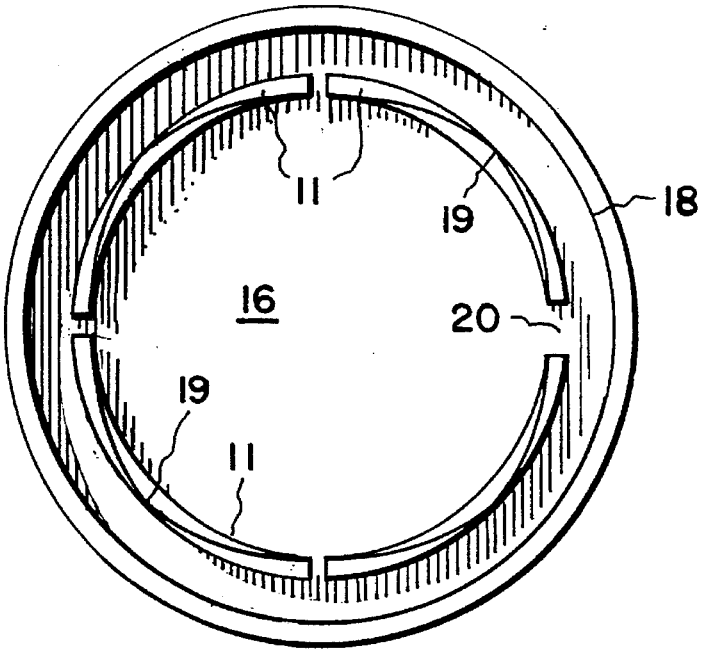
FIGS. 4 and 5 are elevation top views of two embodiments of the membrane-penetrating element of the closure device.

FIG. 4 depicts one embodiment of the membrane-penetrating element of the closure device. Four arciform cutters 11 are coaxial with and in close proximity to the inner surface of the second cylindrical wall 18. A gap 20 between two of the cutters prevents the membrane from being completely detached from the container opening when the membrane-penetrating element is pressed against it.

The distance between the cutters and the-inner surface of the second cylindrical wall should be only slightly greater than the thickness of the walls of the container opening. This allows even flexible membranes of large cross-section to be readily cut by the membrane-penetrating element of this invention, which is greatly superior in this respect to the centered piercing element disclosed in the previously mentioned U.S. Pat. No. 4,340,147. The second cylindrical wall serves both to guide the membrane-penetrating element into proper position over the container opening and to protect the cutters against damage. However, in a less preferred embodiment, the membrane-penetrating element may be constructed without a second cylindrical wall, comprising a plurality of arciform cutters coaxial with and connected to the base on its reverse side, that is, on the side opposite that connected to the cylindrical wall of the cap.

Figure 5:
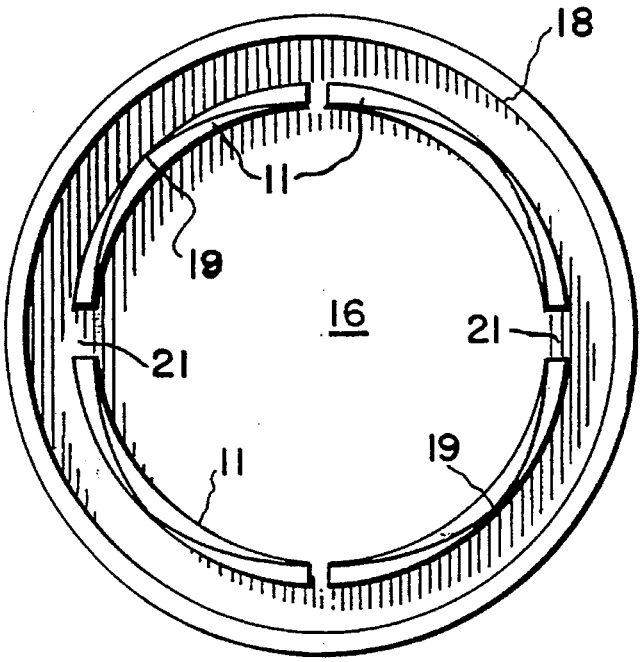

FIG. 5 depicts another embodiment of the membrane-penetrating element, in which the four arciform cutters 11 are separated by two gaps 21, which results in the membrane remaining attached to the container opening at two points. This arrangement facilitates complete removal of the membrane from the container by manual means.

In both of the configurations of arciform cutters depicted in FIGS. 4 and 5, the plurality of cutters together comprise a total of at least 300 degrees, preferably less than 360 degrees, and most preferably between 315 degrees and 345 degrees. The employment of a plurality of cutters, preferably four in number and of relatively low height results in several potential advantages: improved efficiency of penetration of the membrane, requiring the application of little pressure on the device to effect cutting of the membrane; a reduction in the height of the membrane-penetrating element and of the entire device, resulting in a space-saving benefit; and facilitation of the device by plastic molding.

Figure 6:
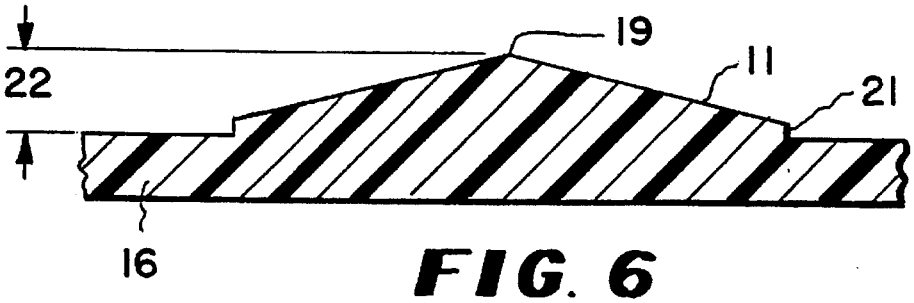
FIG. 6 is a sectional side view of a cutter.

FIG. 6 is a sectional side view of a cutter 11, relatively enlarged to show detail. It depicts the longitudinal cross-section of the cutter as a truncated triangle in which the two vertices adjacent to the base 16 are each replaced by a line 21 perpendicular to the base. The height of these lines is at least a little greater than the thickness of the membrane, and the height 22 of the triangle is at least about three times the height of the line 21. To facilitate penetration of the membrane, the thickness of the cutter is preferably less at the apex 19 than at the base.

Figure 7:
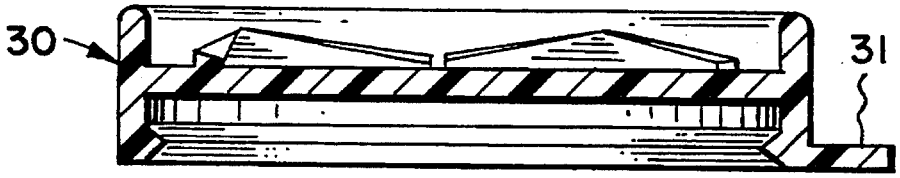
FIGS. 7, 8 and 9 are partial sectional side views of three embodiments of the closure device of the invention.
Figure 8:
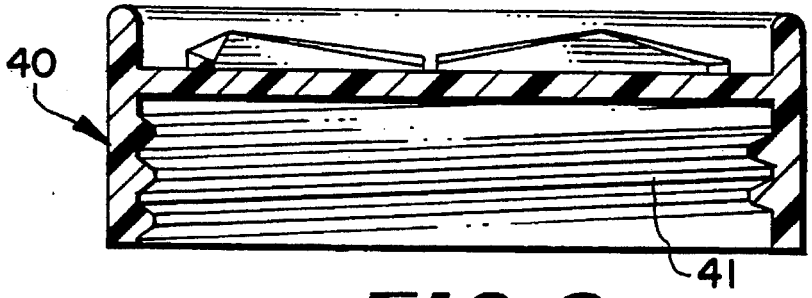
Figure 9:
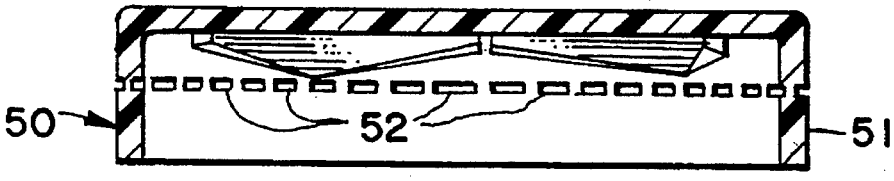

Embodiments of the device of the present invention provide for closure of a wide variety of containers, as previously described. FIGS. 7, 8 and 9 are partial sectional side views of several embodiments of the device of the invention.

FIG. 7 depicts a device 30 with a snap-on cap provided with a tab 31 to facilitate removal of the device from the container by lifting.

FIG. 8 depicts a device 40 in which the inner surface of the cap is provided with helical threads 41 to provide closure for a container with a threaded neck.

FIG. 9 depicts an embodiment 50 which does not require inversion of the device to engage the cutters with the membrane sealing the container opening. Removal of the detachable collar 51 at the line of perforatiori 52 enables the cutters to contact and penetrate the membrane.

Figure 10:
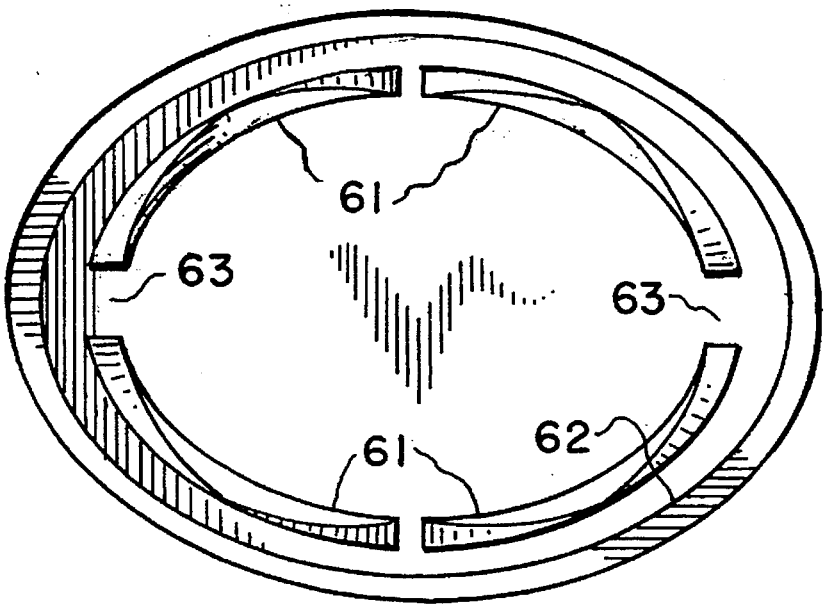
FIGS. 10 and 11 are elevation top views of two further embodiments of the membrane-penetrating element of the closure device.

FIG. 10 depicts an embodiment of the membrane-penetrating element of a device for the closure of a container having an oval-shaped opening. The elongate cutters 61 are in close proximity to the inner surface of the second continuous wall 62, and each cutter is parallel to that portion of the inner surface closest to it. Gaps 63 provide for the membrane to remain attached to the container opening at two points.

Figure 11:
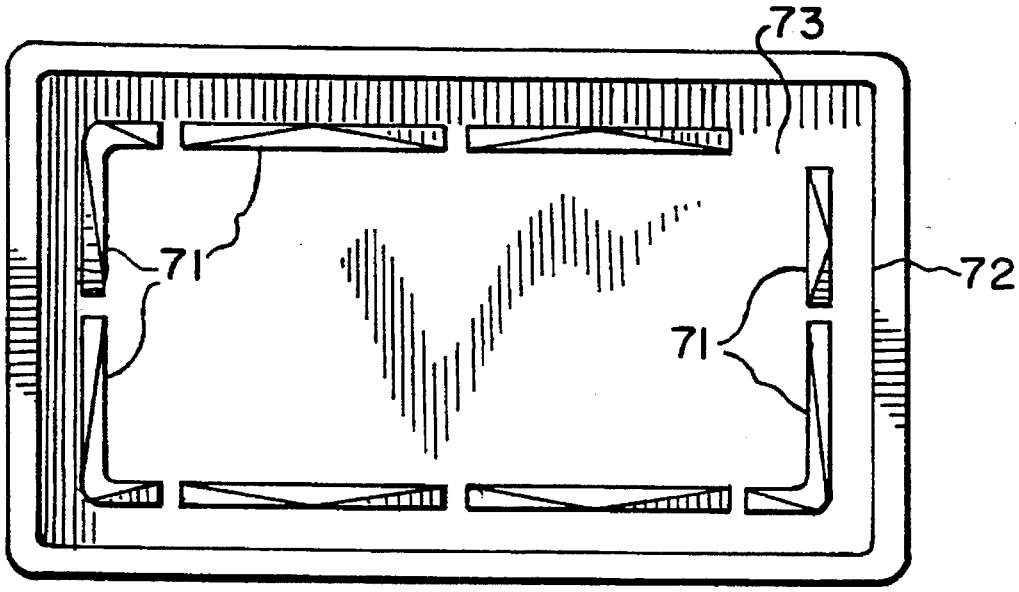

FIG. 11 depicts an embodiment of the membrane-penetrating element of a device for the closure of a container whose opening is substantially rectangular in shape. The cutters 71 are in a close parallel relationship to the second continuous wall 72, and the gap 73 provides for the membrane to remain attached to the opening at one corner. If desired, a cutter may be extended in length to eliminate the gap, thus providing for complete separation of the membrane from the opening by the operation of the membrane-penetrating element.

The invention has been described in detail with particular reference to preferred embodiments thereof, but it will be understood that variations and modifications can be effected within the spirit and scope of the invention.

What is claimed is:

1. A closure device for a container having an opening sealed with a membrane that comprises:

a cap comprising a first cylindrical wall connected to one side of a circular base; and a membrane-penetrating element comprising a second cylindrical wall connected to the reverse side of said circular base and, within said second cylindrical wall, means for penetrating a membrane when said element is pressed into contact with the opening of a container sealed with said membrane, said means comprising a plurality of arciform cutters that are connected to said base and are coaxial with and in close proximity to the inner surface of said second cylindrical wall, said arciform cutters each having an apex and a thickness dimension that is less at said apex than at said base, said plurality of arciform cutters together comprising a total of at least 300 degrees.

2. A closure device according to claim 1 wherein said means for penetrating a membrane comprises four arciform cutters.

3. A closure device according to claim 2 wherein each of said cutters is characterized by substantially the same length, height, and thickness dimensions.

4. A closure device according to claim 1 wherein said cap further comprises threads situated on the inner surface of said first cylindrical wall.

5. A closure device according to claim 1 wherein said cap further comprises a tab to facilitate removal of the cap by lifting from said container.

6. A closure device according to claim 1 wherein said cap further comprises locking means situated on the inner surface of said first cylindrical wall.

7. A closure device for a container having an opening sealed with a membrane that comprises:

a cap comprising a first cylindrical wall connected to one side of a circular base; and a membrane-penetrating element comprising a second cylindrical wall connected to the reverse side of said circular base and, within said second cylindrical wall, means for penetrating a membrane when said element is pressed into contact with the opening of a container sealed with said membrane, said means comprising four arciform cutters that are connected to said base and are coaxial with and in close proximity to the inner surface of said second cylindrical wall, said arciform cutters each having an apex and substantially the same length, height, and thickness dimensions, said thickness dimension being less at said apex than at said base, and said arciform cutters together comprising a total of at least 300 degrees.

8. A closure device according to claim 7 wherein said membrane has a thickness dimension and height of said cutters is at least about three times the thickness of said membrane.

9. A closure device according to claim 7 wherein each of said arciform cutters is characterized by a cross-section in the lengthwise direction of each said arciform cutter that is substantially a truncated triangle in which the two vertices adjacent to the base are each replaced by a line perpendicular to said base.

10. A closure device according to claim 9 wherein said truncated triangle has a height that is at least about three times the height of the lines perpendicular to said base.

11. A closure device according to claim 7 wherein said arciform cutters together comprise less than 360 degrees.

12. A closure device according to claim 11 wherein said arciform cutters together comprise between 315 degrees and 345 degrees.

13. A closure device according to claim 7 wherein said cap further comprises threads situated on the inner surface of said first cylindrical wall.

14. A closure device according to claim 7 wherein said cap further comprises a tab to facilitate removal of the cap by lifting from said container.

15. A closure device according to claim 7 wherein said cap further comprises locking means situated on the inner surface of said first cylindrical wall.

16. A closure device for a container having an opening sealed with a membrane that comprises:

a cap comprising a cylindrical wall connected to one side of a circular base; and a membrane-penetrating element comprising means for penetrating a membrane when said element is pressed into contact with the opening of a container sealed with said membrane, said means comprising a plurality of arciform cutters that are coaxial with and connected to said base on the reverse side of said base, said arciform cutters each having an apex and a thickness dimension that is less at said apex than at said base, said plurality of arciform cutters together comprising a total of at least 300 degrees.

17. A closure device for a container having an opening sealed with a membrane that comprises:

a cap comprising a first continuous wall connected to one side of a base along the perimeter of said base; and a membrane-penetrating element comprising a second continuous wall connected to the reverse side of said base along the perimeter of said base and, within said second continuous wall, means for penetrating a membrane when said element is pressed into contact with the opening of a container sealed with said membrane, said means comprising a plurality of elongate cutters that are connected to said base and are each situated in close proximity to the inner surface of said second continuous wall and in a parallel relationship to that portion of said inner surface closest to each said cutter, said cutters each having an apex and a thickness dimension that is less at said apex than at said base, whereby said membrane is separated completely or substantially completely from said opening when said element is pressed into contact with said opening.

* * * * *